United States Patent [19]

Casey

[11] 4,411,484

[45] Oct. 25, 1983

[54] TERMINATIONS FOR FLAT CABLE

[75] Inventor: Daniel T. Casey, Harrisburg, Pa.

[73] Assignee: AMP Incorporated, Harrisburg, Pa.

[21] Appl. No.: 244,987

[22] Filed: Mar. 18, 1981

Related U.S. Application Data

[62] Division of Ser. No. 122,539, Feb. 19, 1980, Pat. No. 4,335,497.

[51] Int. Cl.[3] ..... H01R 9/07; H01R 4/24

[52] U.S. Cl. ..... 339/97 C; 339/276 T; 29/866

[58] Field of Search ..... 339/17 F, 176 MF, 97 C, 339/276 R, 276 F, 276 SF, 276 T, 223 R, 223 S; 29/857, 861, 863, 865, 866, 748, 749

[56] References Cited

U.S. PATENT DOCUMENTS

| | | | |
|---|---|---|---|
| Re. 26,646 | 8/1969 | Evans | 428/571 |
| Re. 26,837 | 3/1970 | Evans | 339/17 LM |
| 3,363,224 | 1/1968 | Gluntz | 339/258 |
| 3,423,718 | 1/1969 | Cea | 339/223 S |
| 4,082,402 | 4/1978 | Kinkaid et al. | 339/97 C |
| 4,139,937 | 2/1979 | L'Homme | 29/748 |

*Primary Examiner*—Neil Abrams

*Attorney, Agent, or Firm*—Russell J. Egan

[57] ABSTRACT

A method and apparatus are disclosed for terminating multi-conductor cable. A plurality of terminals are preloaded partially into a housing leaving their crimped terminating portions extending therefrom in such a position as they can be readily crimped connected to a cable. This allows for the terminals to be gang handled during the loading of the housing and yet be separated for individual termination on the cable. The cable can be crimped simultaneously to all of the terminals and the terminals fully inserted into the housing in subsequent operations. The terminal used with the subject method and apparatus includes an extra tine which serves alignment, stabilization, and cable positioning functions.

2 Claims, 9 Drawing Figures

TERMINATIONS FOR FLAT CABLE

CROSS REFERENCE TO RELATED APPLICATION

This is a division of application Ser. No. 122,539 filed Feb. 19, 1980, now U.S. Pat. No. 4,335,497.

BACKGROUND OF THE INVENTION

1. The Field Of The Invention

The present invention relates to a method for terminating multi-conductor flat flexible cable and to the apparatus and terminal for effecting such termination.

2. The Prior Art

It is heretofore been the practice to terminate multi-conductor flat flexible cable by sequentially applying terminals to the conductors of the cable. The thus terminated cable is then applied to the connector housing requiring that each terminal be individually applied to the appropriate terminal passage in the housing. While this is very convenient for the sequential application of the terminals to the cable, it is almost necessary to have a hand loading operation to assure that the free floating terminals are applied to their correct passages. The present invention overcomes the difficulties of this known system by partially preloading the terminals into the passages to a position where their crimp portions extend from the housing where they can be subsequently crimp terminated to a multi-conductor flat flexible cable and then fully inserted into the housing.

SUMMARY OF THE INVENTION

The present invention concerns a method, apparatus and terminal for terminating multi-conductor flat flexible cable and includes the steps of preloading a plurality of terminals into appropriate terminal passages in a housing only sufficiently far to insure their correct positioning therein while leaving their crimp terminating portions exposed. The cable to be terminated is applied to the exposed crimp terminating portions which are then crimp connected to the respective conductors of the cable. The thus terminated cable is then fully applied to the connector by driving all of the terminals completely into the housing. This can be readily accomplished since the terminals are all secured to the cable and are aligned in their respective passages in the housing.

The apparatus for accomplishing the above termination method includes a terminal having a known mating portion and a known crimping portion with an intermediate portion including a time initially extending at right angles to the longitudinal axis of the terminal. This tine serves as for stabilization of the terminal within the housing as well as cable and terminal alignment means. The tine is subsequently curled down during the crimping step to enable passage of the crimped terminal into its appropriate passageway in the housing.

The apparatus for effecting the above termination method includes an applicator which simultaneously severs a carrier strip from a plurality of terminals which have been partially preloaded into a housing and crimp terminates the conductors of a flat flexible cable to the respective terminals extending from the housing.

It is therefore an object of the present invention to produce an improved apparatus for terminating the conductors of a multi-conductor flat flexible cable onto a plurality of terminals which have been partially preloaded into a housing.

It is another object of the present invention to teach a method of terminating multi-conductor flat flexible cable by partially loading a plurality of terminals into a connector housing, then gang crimping the terminals to the respective conductors of a multi-conductor flat flexible cable and subsequently fully inserting the crimped terminals into the housing.

It is another object of the present invention to produce an improved terminal having, in addition to a crimp portion and a mating portion, an intermediate tine which serves to align the terminal with respect to the housing, to stabilize the terminal in the housing and to position the cable with respect to the terminal prior to being crimped so as to be receivable within the housing.

It is a further object of the present invention to produce a terminal and apparatus which can be readily and economically manufactured.

The means for accomplishing the foregoing objects and other advantages of the present invention will be apparent to those skilled in the art from the following detailed description taken with reference to the accompanying drawings.

DETAILED DESCRIPTION OF THE PREFERRED EMBODIMENT

Figure 1:
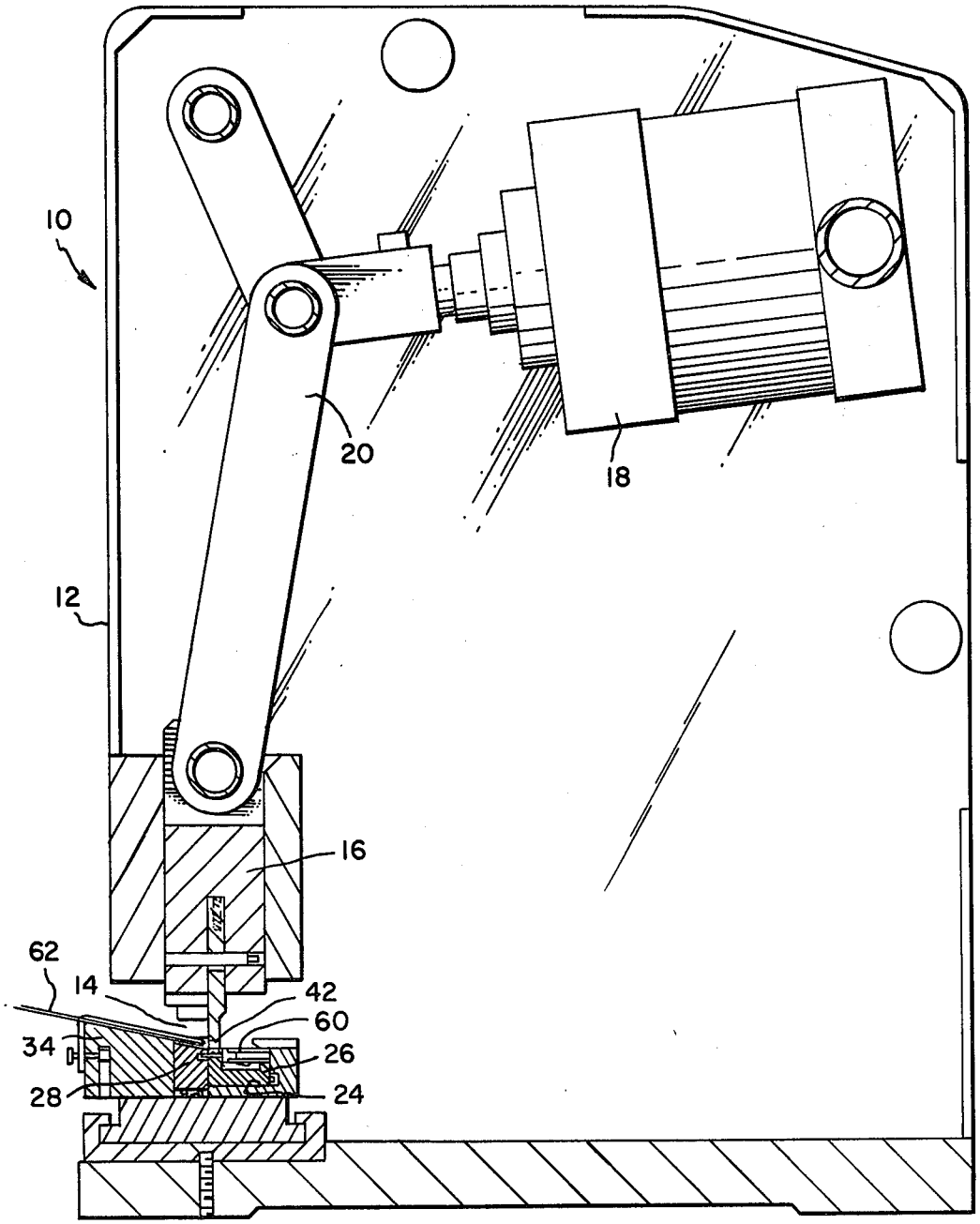
FIG. 1 is a vertical transverse section through a crimp apparatus according to the present invention.
Figure 2:
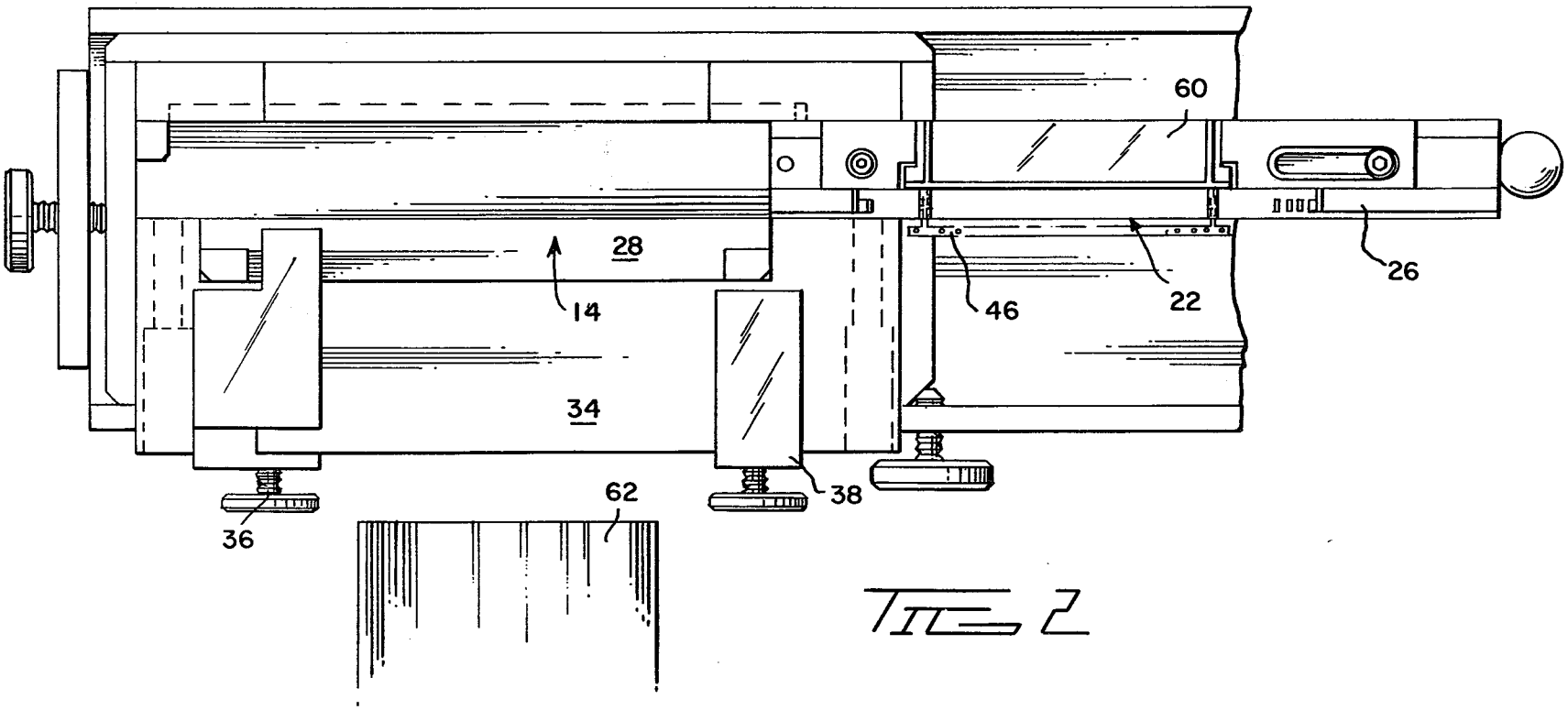
FIG. 2 is a top plan view through the apparatus of FIG. 1.
Figure 3:
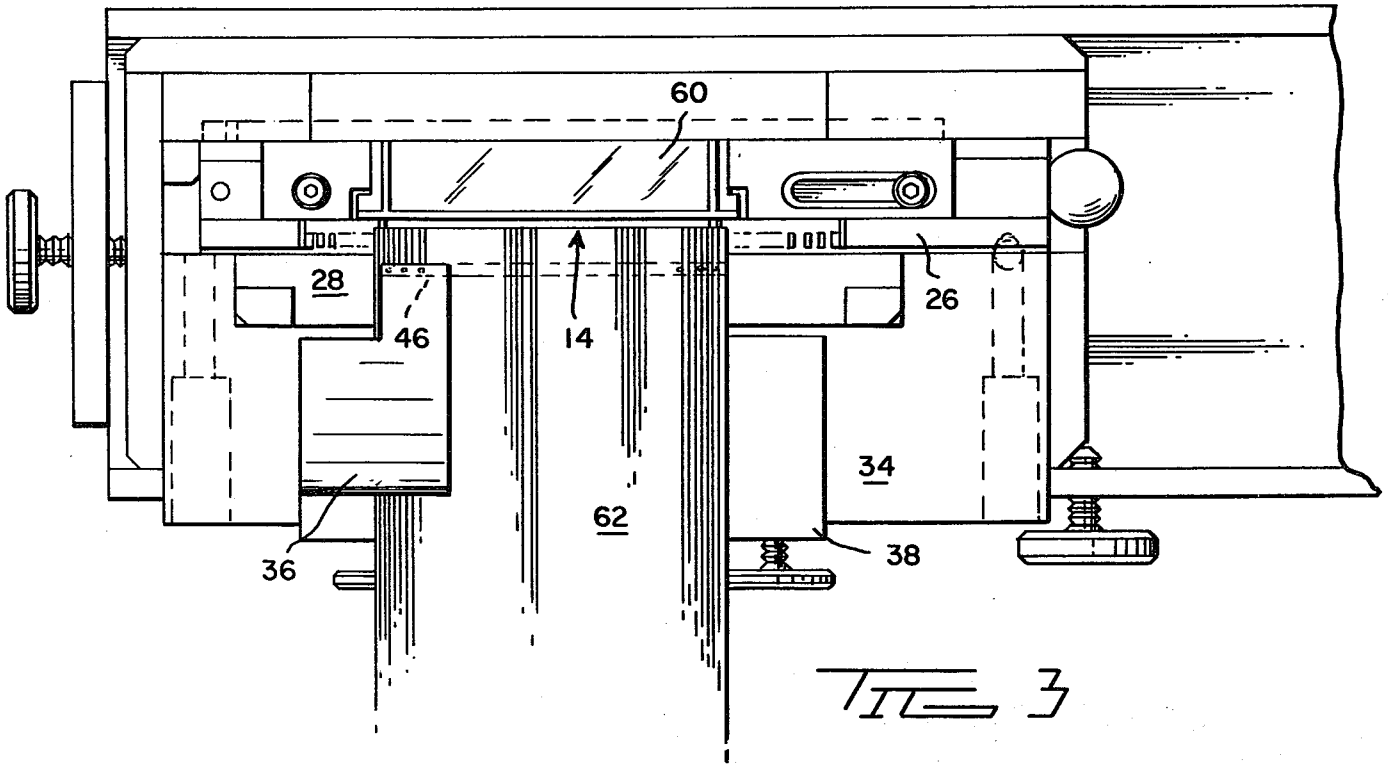
FIG. 3 is a view similar to FIG. 2 showing the subject apparatus during crimping of a cable.

The applicator is shown in FIGS. 1 to 3 and includes a housing 12 having a work station 14 positioned beneath a ram 16 which is vertically driven by a pneumatic cylinder 18 through linkages 20. A feed path leads from a loading station 22 into the work station 14 and includes a trough 24 in which a connector housing holding jig 26 slides. A carrier strip shear bar 28 forms the front wall of the trough 24 in the work station. The shear bar 28 is biased upwardly by springs 30 so that its upper surface 32 normally forms a continuation of the fixed inclined cable receiving member 34. Adjustable cable alignment members 36, 38 are positioned toward opposite ends of the member 34 which can have a fluted surface for alignment of the cable. A horizontal channel 40 is formed in the shear bar directed towards the trough 24. The ram 16 carries a crimp tool 42 and actuation member 44.

Figure 4:
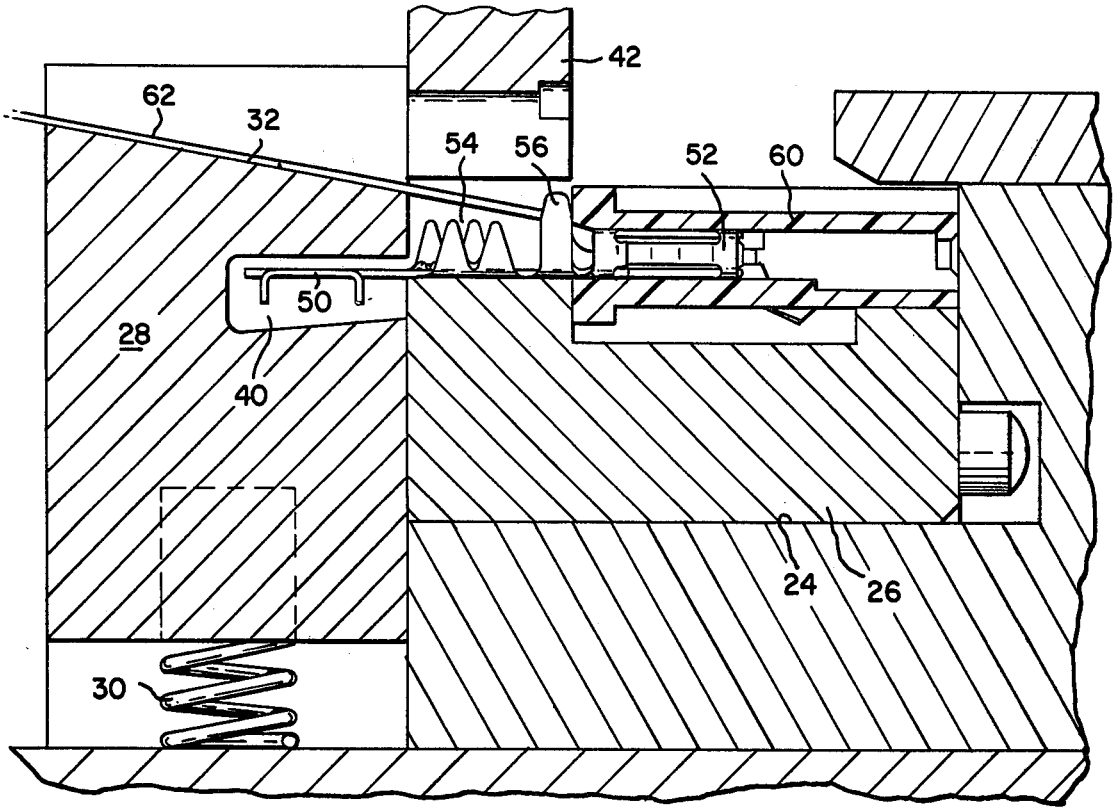
FIG. 4 is a detailed section through the crimp portion of the subject apparatus immediately prior to effecting a crimp.
Figure 6:
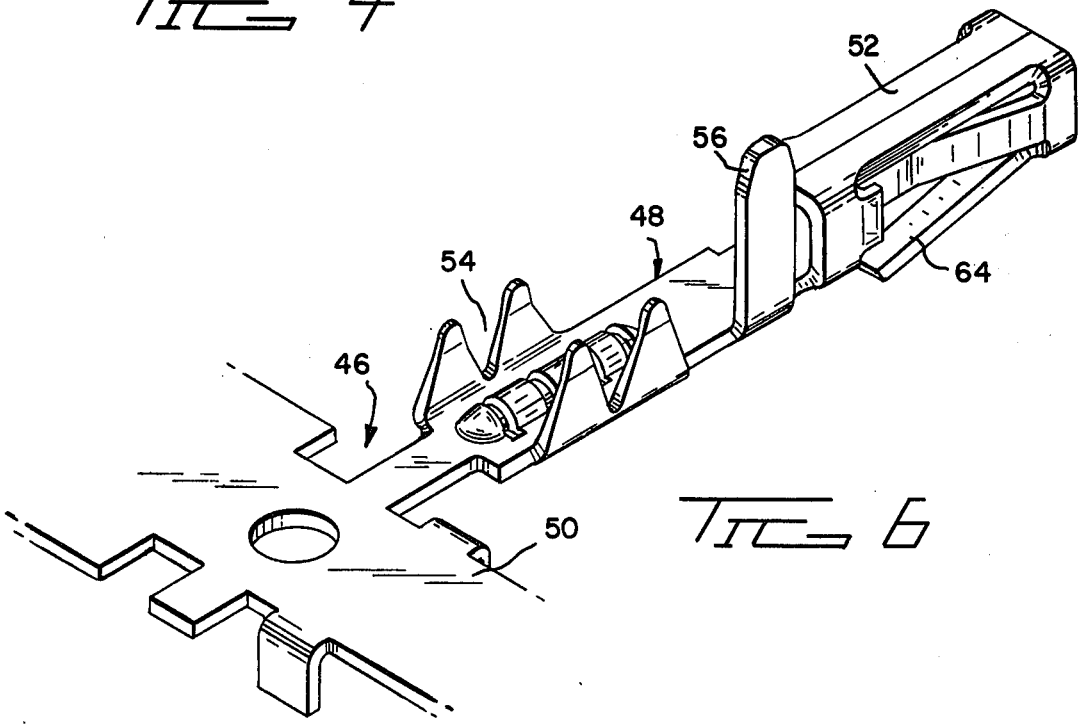
FIG. 6 is a perspective of a terminal according to the present invention while still attached to a carrier strip.
Figure 7:
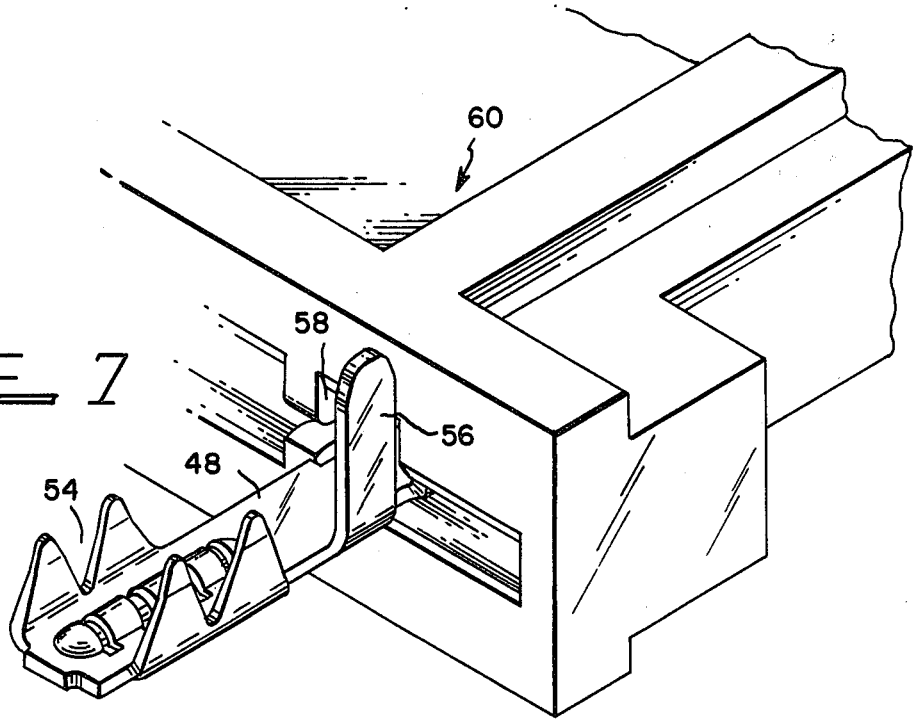
FIG. 7 is a perspective view of the subject terminal in its initial condition partially inserted into a housing and prior to crimping.

The subject terminal strip 46 can most clearly be seen in FIG. 6 including a plurality of terminals 48 extending from a carrier strip 50. It should be here noted that strips of the subject terminals can be stacked double, in the manner shown in U.S. Pat. No. 4,021,095, so that the terminals will be on a closer center line spacing than would be possible to stamp them out from conventional stock. Each terminal has a mating portion 52 which is here shown as a receptacle of the type shown in U.S. Pat. Nos. Re 26,646, Re 26,837, and 3,363,224 and a crimp portion 54 which is of the type described in U.S. Pat. No. 4,082,402. Intermediate these two portions is a tine 56 which extends normal to the axis of the terminal and to one side of the body thereof. The function of this tine can best be seen from FIGS. 4 and 7 in which it will be noted that the tine 56 serves to align the terminal 48 with respect to the terminal passage 58 in housing 60 and prevent the initial full insertion of the terminal into the passage. It will also be noted from FIG. 4 that the tine 56 also serves as an abutment against which the cable 62 is placed prior to termination and thus assures the proper alignment of the cable with respect to the crimp portion 54 of the terminal.

Figure 5:
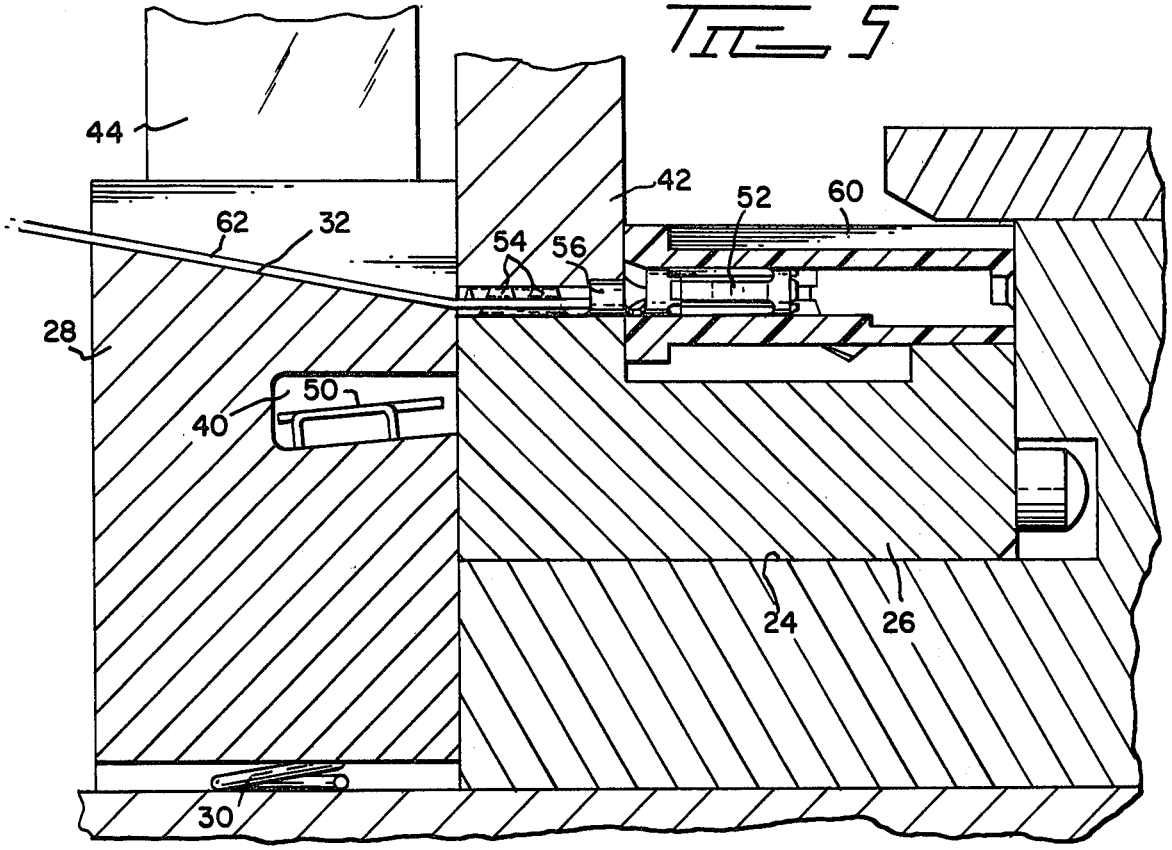
FIG. 5 is a view similar to FIG. 4 showing the apparatus during crimping.
Figure 8:
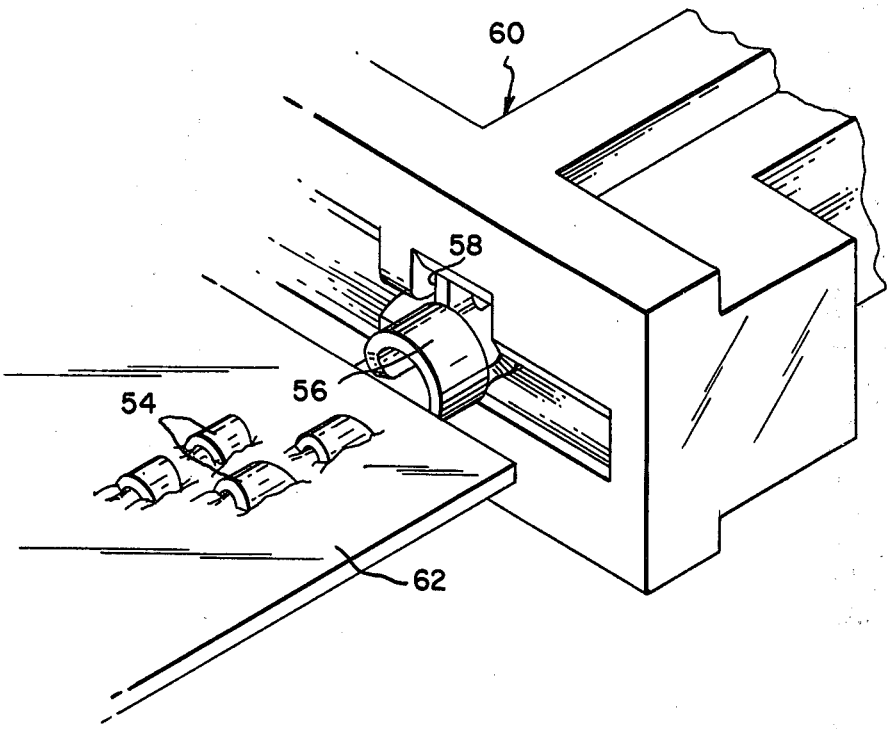
FIG. 8 is a view similar to FIG. 7 showing the subject terminal immediately after crimping and prior to full insertion into the housing.

The crimping of the terminal on the cable can be seen from FIGS. 5 and 8 with the crimp tool 42 effecting both a crimp of the crimp portin 54 and a curling down of the tine 56 so that it will be free of the housing and allow full insertion of the terminal into the passage 58. Simultaneously with the crimping, the carrier strip 50 is sheared from the terminals 48 by the shear bar 26 being driven downward against springs 30 by actuation member 44.

Figure 9:
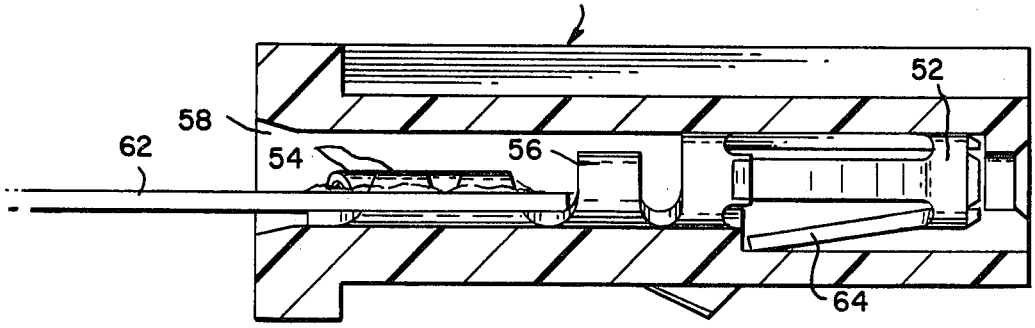
FIG. 9 is a vertical transverse section through the housing showing the crimped terminal in a fully inserted condition.

After the teminals have been crimped to the respective conductors of the cable, the cable is pushed forwardly to fully insert the terminals into the housing where lances 64 (see FIG. 9) engage to hold the terminals and cable in place.

The present invention may be subject to many modifications and changes without departing from the spirit or essential characteristic thereof. The present embodiment is therefore to be considered in all respects as illustrative and not restrictive as to the scope of the invention.

What is claimed is:

1. In combination with an electrical connector and a flat multi-conductor cable, said connector having an insulating housing with at least one terminal receiving passageway therein, a like number of electrical terminals each having a crimp portion adapted to be crimped to a flat electrical conductor of said cable, a mating portion connected to the crimp portion, and a tine provided on the terminal, said tine forming means for limiting the insertion of the terminal into a respective passageway when the terminal is initially inserted therein with its mating portion leading, so that the crimp portion remains wholly outside the passageway, the tine being subsequently deformable to allow the crimp portion of the terminal to be inserted into the passageway; characterized in that the tine is upstanding from the terminal between the mating portion and the crimp portion thereof so as to engage an external wall of the housing defining an end of the passageway, when the mating portion has been inserted into the passageway through such end, and in that the tine is plastically deformable so as to lie within the cross-section of the passageway, said tine forming means for abutting an edge of said flat cable to limit edgewise advancement of said cable and to correctly position said cable edge with respect to the terminal crimp portion.

2. A connector according to claim 1, characterized in that, said tine adjoins an edge of a web portion of the terminal connecting the mating portion to the crimp portion, the tine initially extending substantially perpendicularly to the plane of the web portion.

* * * * *